US007837319B2

(12) United States Patent
Rodin et al.

(10) Patent No.: US 7,837,319 B2
(45) Date of Patent: Nov. 23, 2010

(54) DIGITAL INK JET PRINTING METHOD AND APPARATUS AND CURING RADIATION APPLICATION METHOD

(75) Inventors: Gregory Rodin, Rishon Le Zion (IL); Kobi Markovich, Rehovot (IL)

(73) Assignee: Hewlett-Packard Singapore (Private) Ltd., Singapore (SG)

( * ) Notice: Subject to any disclaimer, the term of this patent is extended or adjusted under 35 U.S.C. 154(b) by 894 days.

(21) Appl. No.: 10/576,974

(22) PCT Filed: Oct. 21, 2004

(86) PCT No.: PCT/IL2004/000968

§ 371 (c)(1),
(2), (4) Date: Apr. 12, 2007

(87) PCT Pub. No.: WO2005/039883

PCT Pub. Date: May 6, 2005

(65) Prior Publication Data

US 2007/0273739 A1 Nov. 29, 2007

(30) Foreign Application Priority Data

Oct. 23, 2003 (IL) ..... 158571

(51) Int. Cl.
*B41J 29/38* (2006.01)
*B41J 2/01* (2006.01)

(52) U.S. Cl. ..... 347/102; 347/15; 347/16; 347/95; 347/106; 427/96.1; 427/487; 428/203; 118/620; 250/492.1

(58) Field of Classification Search ..... None
See application file for complete search history.

(56) References Cited

U.S. PATENT DOCUMENTS

| | | | | |
|---|---|---|---|---|
| 3,943,046 | A | 3/1976 | De Sorga et al. | |
| 4,048,036 | A | 9/1977 | Prucnal | |
| 4,165,265 | A | 8/1979 | Nakabayashi et al. | |
| 4,313,969 | A | 2/1982 | Matthews et al. | |
| 4,411,931 | A | 10/1983 | Duong | |
| 5,585,415 | A | 12/1996 | Gorzalski et al. | |
| 6,145,979 | A | 11/2000 | Caiger et al. | |
| 6,447,112 | B1 | 9/2002 | Hu et al. | |
| 6,454,405 | B1 | 9/2002 | Stowe | |
| 6,561,640 | B1 * | 5/2003 | Young | 347/102 |

(Continued)

FOREIGN PATENT DOCUMENTS

DE 20316180 U1 5/2004

(Continued)

*Primary Examiner*—Matthew Luu
*Assistant Examiner*—John P Zimmermann

(57) ABSTRACT

A method and apparatus a digital ink-jet printer are presented. A radiation-curable ink is continuously applies to successive locations on a substrate along a print line extending across the substrate. Concurrently with the continuous application of the radiation-curable ink along the print line, first curing radiation of a predetermined first intensity is continuously applied to the applied ink on the successive locations on the substrate along said print line, with a certain time delay, constant for all the locations on the substrate, between the applications of ink and the first curing radiation. Second curing radiation of a predetermined second intensity is applied to the locations on the substrate a certain time period, constant for all the locations on the substrate, after the application of the first curing radiation to said locations.

12 Claims, 4 Drawing Sheets

U.S. PATENT DOCUMENTS

| | | | | |
|---|---|---|---|---|
| 6,630,083 | B1 * | 10/2003 | Nunez et al. | 264/1.38 |
| 6,739,716 | B2 * | 5/2004 | Richards | 347/102 |
| 6,910,764 | B2 * | 6/2005 | Nakajima | 347/102 |
| 6,973,874 | B2 * | 12/2005 | DeMoore et al. | 101/424.1 |
| 7,638,780 | B2 * | 12/2009 | Kilburn et al. | 250/492.1 |
| 2002/0044188 | A1 * | 4/2002 | Codos | 347/106 |
| 2005/0018026 | A1 * | 1/2005 | Nerad et al. | 347/102 |
| 2006/0121208 | A1 * | 6/2006 | Siegel | 427/487 |

FOREIGN PATENT DOCUMENTS

| | | | |
|---|---|---|---|
| EP | 1072659 | A1 | 1/2001 |
| EP | 1348566 | A2 | 10/2003 |

* cited by examiner

DIGITAL INK JET PRINTING METHOD AND APPARATUS AND CURING RADIATION APPLICATION METHOD

FIELD OF THE INVENTION

This invention relates to digital ink jet printing apparatus and processes, and specifically to digital ink jet printing techniques employing radiation-curable inks such as UV-curable inks.

BACKGROUND OF THE INVENTION

Inkjet technology typically utilizes radiation-curable inks, namely, ultra-violet (UV) sensitive inks. Printing apparatuses thus include, inter alia, a printing head assembly and a curing assembly (radiation source). The motion of the curing radiation source is synchronized with the motion of the printing head so as to sequentially apply curing to the previously sequentially printed locations.

The curing radiation source may be accommodated at a certain distance from a printing head and move together with the printing head with respect to a recording medium (substrate) along a printing line (across the substrate). Alternatively, a curing radiation source may be stationary mounted and equipped with optics (mirrors) movable together with a printing head.

U.S. Pat. No. 6,145,979 discloses an ink jet printer for forming an image on a moving substrate. Here, an ink curing apparatus has a radiation source stationary mounted outside the printer, and the curing radiation source is optically coupled to a mirror or a radiation-emitting head that directs the radiation to a desired location downstream of the printing head.

U.S. Pat. No. 6,454,405 discloses an ink-jet applicator using UV-curable ink. The applicator includes a print head, a guide operably secured to the print head housing to guide it across a medium being imprinted, a UV light source at one end of the guide and a mirror carried by the print head housing and oriented to reflect the UV beam onto the UV curable coating deposited by the print head. This technique is aimed at reducing the mass required to be added to the print head by the UV curing station.

Another technique aimed at reducing the mass of the printhead, in an inkjet printer utilizing radiation curing system, is disclosed in U.S. Pat. No. 6,447,112. According to this technique, the radiation source moves independently of the printhead to provide the desired electromagnetic curing energy to the printed ink.

In some material deposition processes, multi-stage UV curing is used:

U.S. Pat. No. 3,943,046 describes a UV curing process and apparatus for polymerizing oxygen-inhibited UV photopolymerizable resin-forming material, such as a film. This is implemented by using a pair of UV light sources, one being a flash photolysis source, and the other being a sustained photolysis source.

U.S. Pat. No. 4,048,036 describes a method of producing oxygen inhibitable UV curable coatings. Here, a desired flatting is obtained when films of oxygen inhibitable UV curable coating compositions containing flatting pigment are exposed to UV light, first in an oxygen containing atmosphere and then in a substantially oxygen free atmosphere.

U.S. Pat. No. 4,165,265 discloses a multi-stage irradiation method of curing a photocurable coating composition. Here, actinic radiation is used in the presence of air. The initial step involves irradiation with actinic radiation having wavelengths 185-500 millimicrons with dominant wavelength or wavelengths between 380-420 millimicrons, and the subsequent step involves irradiation with another actinic radiation of wavelengths within the same range as those of the radiation used for the initial step, but having dominant wavelength or wavelengths within a range shorter than those of the radiation used therefore. The initial irradiation is effected so as to cure the lower part of the coating layer with the surface portion thereof left uncured, and the subsequent irradiation leads to the full cure of the surface portion thereof.

U.S. Pat. No. 4,313,969 discloses a method and apparatus for providing low gloss and controlled gloss radiation cured coatings. According to this technique, a radiation curable coating of a composition including inert particulates is first irradiated with curing radiation of wavelength to which the coating is responsive but having no distribution beneath 300 nm, and is subsequently irradiated with curing radiation of wavelength to which the coating is responsive including radiation at wavelength beneath 300 nm. Gloss control is achieved by adjusting the spectral distribution, the intensity or the dose of the initial radiation, or by adjusting the time interval between the initial and the subsequent radiation steps.

U.S. Pat. No. 4,411,931 discloses a three-stage UV curing process for providing accurately controlled surface texture, particularly are useful as floor and wall coverings. A UV-curable substrate is initially exposed to long wave length light of low intensity, thereby causing the bottom portion of the substrate to gel while leaving the top surface essentially unaffected. The first stage irradiation is followed by irradiation with shorter-wave length UV light under an inert atmosphere, thereby causing the surface of the substrate to gel. The final stage of the curing process involves conventional exposure to strong UV light whereby the entire structure is cured to give a product having finely controlled surface texture.

U.S. Pat. No. 5,585,415 discloses pigmented compositions and methods for producing radiation curable coatings of very low gloss. This technique utilizes inclusion of a combination of photoinitiators having an acylphosphine oxide photoinitiator and a second photoinitiator such as an acetophenone derivative. The coating is first exposed to ionizing radiation (e.g., electron beam) in air, and then exposed to actinic radiation (ultraviolet light) in an essentially inert atmosphere.

EP 1072659 discloses a composition and process for providing a gloss controlled, abrasion resistant coating on surface covering products. The composition is cured to create a wearlayer surface, preferably on a floor covering product. The surface covering product is prepared and then the coating is partially cured by exposure to low peak irradiance UV light in either ambient or inert air, followed by fully curing the coating with high peak irradiance UV light in inert atmosphere to form a low gloss abrasion resistant wearlayer surface. Alternatively, the single-step exposure of the composition to high peak irradiance UV light in ambient atmosphere is used.

SUMMARY OF THE INVENTION

There is a need in the art to facilitate digital ink jet printing by providing a novel printing method and apparatus, particularly useful for wide format printing and very wide format printing.

The main aspects of the present invention are associated with providing bi-directional printing and preferably also double-stage curing of the printed ink. When dealing with wide format printing (1 meter and over) and very wide format printing (about 5 meters), the print head's movement from one side to the other side of a substrate (recording medium) is extremely time consuming, and therefore it is very important to enable bi-directional printing.

The present invention provides for on-line gloss control of inkjet printed images, improved adhesion, better drop shaping and better shrinkage properties. This is achieved by controlling the delay time between the application of the ink (printing) to a certain location on the substrate and curing the printed ink, and also by controlling the amount of curing energy and wavelength of the curing radiation. In digital ink-jet printers, the typically used single-stage curing consist of irradiating printed ink with high intensity UV radiation and the resulting images normally have a matte finish. In order to achieve a glossy finish, the present invention utilizes a double-stage curing: At the first-stage curing, energy with relatively low intensity and long wavelength irradiates the ink droplet that has been applied to the substrate, and at the second, delayed curing stage, UV radiation of relatively higher energy and shorter wavelength irradiates the same droplet after a certain time period from the first-stage curing. Preferably, the intensity of UV radiation at first-stage curing is 15% or less than that of the second-stage curing.

There is thus provided according to one aspect of the present invention, a method for use in a digital ink-jet printer, the method comprising:

(i) continuously applying a radiation-curable ink to successive locations on a substrate along a print line extending across the substrate;

(ii) concurrently with the continuous application of the radiation-curable ink along the print line, continuously applying first curing radiation of a predetermined first intensity to the applied ink on the successive locations on the substrate along said print line, with a certain time delay, constant for all the locations on the substrate, between the applications of ink and the first curing radiation;

(iii) applying second curing radiation of a predetermined second intensity to the locations on the substrate a certain time period, constant for all the locations on the substrate, after the application of the first curing radiation to said locations.

The configuration is preferably such that after one or more print lines on the substrate are printed and first-cured, the second curing radiation is continuously applied to successive locations along these print lines, while next print line(s) undergoes the process of printing and first-curing.

Generally, the first- and second-stage curing may be carried out by first and second radiation sources, respectively. Preferably, however, a single radiation source and appropriately designed radiation directing arrangement is used for performing the first- and second-stage curing.

Preferably, the application of the radiation-curable ink is carried out in a bi-directional manner, namely, while displacing a print head assembly in opposite directions with respect to the substrate. In this case, a curing assembly may generally comprise two curing units accommodated at opposite sides of the print head assembly and selectively operable to carry out the first-stage curing during the line printing in the opposite directions, respectively. However, a printing system equipped with two curing units or more than two curing units when multi-stage curing is needed, would be too bulky. The present invention provides an efficient apparatus and method for printing and curing radiation-sensitive ink in bi-directional printing with the single curing radiation source and a radiation directing arrangement configured to enable the curing while printing in the opposite directions.

There is thus provided according to another aspect of the invention, an ink-jet printing apparatus comprising:

(a) a print head assembly having one or more inkjets and operable for applying radiation-curable ink onto the substrate;

(b) a drive means operable to provide a relative displacement between the substrate and the print head assembly in first and second opposite directions along a print line extending across the substrate, thereby enabling application of the radiation-curable ink to successive locations along the print line;

(c) an ink curing assembly comprising a radiation source and a radiation directing arrangement, the radiation directing arrangement being accommodated in the path of the radiation coming from the radiation source and operable to selectively direct said radiation to the print line on the substrate along either one of the first and second directions during the relative displacement between the substrate and the print head assembly, the radiation directing arrangement being oriented with respect to the print head assembly so as to allow curing of the applied ink with a certain time delay, constant for all the locations on the substrate, between the application of ink and the application of curing radiation to the substrate.

Preferably, the application of ink along the print line utilizes movement of the print head assembly with respect to the substrate, and application of ink to successive print lines on the substrate utilizes movement of the substrate with respect to the print head assembly.

The ink curing assembly is preferably mounted for movement together with the print head assembly.

The radiation directing arrangement may comprise first and second mirrors accommodated symmetrically identical with respect to the print head assembly at opposite sides thereof; and a third mirror that is accommodated in the path of radiation coming from the radiation source and is movable so as to selectively orient its reflective surface to face either one of the first and second mirrors. The radiation source may be accommodated adjacent to the print head assembly, or may be accommodated remotely from the print head assembly in which case the third mirror is located adjacent to the print head assembly and radiation is directed from the radiation source to the third mirror via fiber. Each of the first and second mirrors may be kept at a certain fixed distance from the print head assembly (e.g., about 10-15 cm), or may be displaceable with respect to the print head assembly, such that when printing in one direction is carried out, one of the mirrors is located adjacent to the print head assembly (say, "zero-distance") and the other mirror is displaced from the opposite side of the print head assembly (e.g., a distance of about 70 cm).

In order to implement the second-stage curing, a separate curing assembly may be provided, for example located adjacent to the print head assembly and movable together with the print head assembly, but such as to apply second curing radiation to previously printed and first-stage cured locations at a certain time delay between the first- and second-stage curing processes, constant for all the locations on the substrate.

Preferably, the first- and second-stage curing utilize the same radiation source. This can be implemented by replacing either first and second mirrors by radiation splitting elements, or replacing the third mirror by a radiation splitting element. The splitting element may be wavelength-dependent.

According to yet another aspect of the present invention, there is provided an ink-jet printing apparatus comprising:

a print head assembly having one or more inkjets and operable for applying radiation-curable ink onto the substrate;

a drive assembly including first drive means operable to provide a relative displacement between the substrate and the print head assembly in first and second opposite directions along a print line extending across the substrate, thereby enabling application of the radiation-curable ink to successive locations along the print line; and a second drive means operable to provide a relative displacement between the print head assembly and the substrate in a direction perpendicular to the print line;

an ink curing assembly comprising a radiation source and a radiation directing arrangement, the radiation directing arrangement being accommodated in the path of the radiation coming from the radiation source and being configured and operable to split said radiation into first and second radiation portions of predetermined intensities and direct them onto two spaced-apart locations on the substrate both spaced from the location to which the ink is applied, thereby providing the application of the first curing radiation to the substrate with a certain time delay between the application of ink and the application of the first curing radiation to the substrate constant for all the locations on the substrate, and providing the application of the second curing radiation to the substrate a certain time period after the application of the first curing radiation constant for all the locations on the substrate.

According to yet another aspect of the present invention, there is provided an ink-jet printing apparatus comprising:

a print head assembly having one or more inkjets and operable for applying radiation-curable ink onto the substrate;

a drive assembly including first drive means operable to provide a relative displacement between the substrate and the print head assembly in first and second opposite directions along a print line extending across the substrate, thereby enabling application of the radiation-curable ink to successive locations along the print line, and a second drive means operable to provide a relative displacement between the print head assembly and the substrate in a direction perpendicular to the print line;

an ink curing assembly comprising a radiation source and a radiation directing arrangement, the radiation directing arrangement being accommodated in the path of the radiation coming from the radiation source and being configured and operable to split said radiation into first and second radiation portions of predetermined intensities and direct them onto spaced-apart locations on the substrate both spaced from the location to which the ink is applied, said radiation directing arrangement being configured to selectively direct said first radiation portion to the print line on the substrate along either one of the first and second directions during the relative displacement between the substrate and the print head assembly with a certain time delay between the application of ink and the application of the first curing radiation to the substrate constant for all the locations on the substrate, and direct the second curing radiation to the substrate a certain time period after the application of the first curing radiation constant for all the locations on the substrate.

BRIEF DESCRIPTION OF THE DRAWINGS

In order to understand the invention and to see how it may be carried out in practice, preferred embodiments will now be described, by way of non-limiting example only, with reference to the accompanying drawings, in which.

DETAILED DESCRIPTION OF THE INVENTION

Figure 1A:
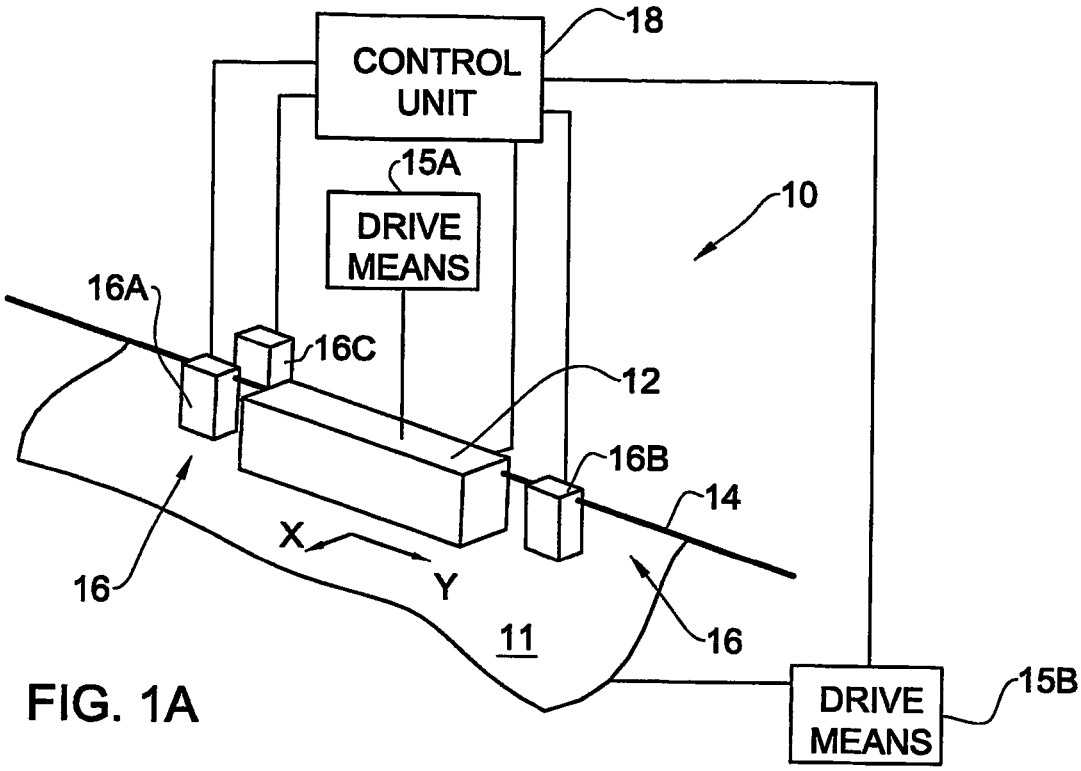
FIG. 1A illustrates a printing apparatus according to one embodiment of the invention configured to implement bi-directional printing and double-stage UV curing of the printed ink.

Referring to FIG. 1A, there is illustrated a printing apparatus 10 according to one embodiment of the invention. The apparatus 10 is configured to be used in a digital ink jet printer for printing on a substrate 11, and comprises, inter alia, a print head assembly 12 mounted on a guide 14 and operated by a drive assembly 15A for sliding movement along the axis of the guide (X-axis) in opposite directions; a UV-curing assembly 16; and a control unit 18 connectable to the print head assembly and to the curing assembly.

It should be understood that the drive assembly 15A serves for providing a relative displacement between the print head assembly 12 and the substrate 11 along the X-axis, and may alternatively be associated with the substrate support means. Further provided is a drive assembly 15B operable to provide a relative displacement between the substrate and the print head assembly 12 along the Y-axis. The drive assembly 15B is typically associated with the substrate support means, but may generally be coupled to the print head assembly 12.

In the present example, the curing assembly 16 is mounted for movement together with the print head assembly by the drive assembly 15A. This may for example be implemented by providing the connection between the print head and the curing assemblies.

The print head assembly 12 may be of any known design, for example that commercially available from Nur Macroprinters, Israel, and therefore its construction and operation need not be specifically described, except to note the following: The print head assembly typically includes one or more inkjets for applying radiation-curable ink onto the substrate during the relative displacement between the substrate and the print head assembly along the X-axis (across the substrate).

The control unit 18 is typically a computer system having inter alia a memory utility for storing reference data indicative of the operational modes of the print head assembly and the curing assembly; a processor utility preprogrammed to operate the print head and curing assemblies accordingly; and a suitable interface utility. The apparatus 10 is configured to implement bi-directional printing and ink-curing. The control unit 18 thus operates the print head assembly 12 to apply radiation-curable ink to the substrate 11 during the movement in the opposite directions along the guide (along the X-axis).

Additionally, the apparatus 10 is configured to carry out double-stage UV curing of the printed ink. In the present example, the curing assembly 16 includes three UV-curing units (light sources) 16A-16C. First and second UV-curing units 16A and 16B are mounted on the guide 14 at opposite sides of the print head assembly 12 so as to be movable together with the print head assembly and perform a first-stage curing of the printed ink during the printing in the opposite directions, respectively. A distance between the curing unit 16A (or 16B) and the print head assembly 12 is defined by a preset time delay between the printing and first-stage curing processes to be applied to each location on the substrate, as well as by the X-axis dimension of the print head. For example, the time delay $t_1$ between the printing and the first-stage curing processes, constant for all locations (dots) in the print line, is about 0.5 sec for the 0.5 m-length print head assembly, a distance between the unit 16A (or 16B) and the print head being about 5-10 cm. The third UV-curing unit 16C is mounted on the guide 14 (or on a separate guide parallel to guide 14) so as to move synchrony with the print head assembly 12 (and with the UV-curing units 16A and 16B) while being downstream thereof with respect to a direction of the substrate movement relative to the print head assembly (Y-direction), and to carry out a second-stage curing of the previously printed and first-cured ink. A time delay $t_2$ between the first-stage and second-stage curing processes may be up to 10 sec (preferably 2-4 sec), depending on a step-movement of the substrate along the Y-axis.

It should be noted that curing units 16A and 16B may be kept at the same fixed distance from the print head assembly (for example, a distance of about 10-15 cm). Alternatively, each of these units may be displaceable with respect to the print head assembly: For example, when printing in the positive X-direction is carried, curing unit 16B is brought close to the print head assembly, and the curing unit 16A is displaced from the print head assembly a predetermined distance (e.g., a distance of about 70 cm), while during the printing in the negative X-direction, unit 16A is located close to the print head assembly, and unit 16B is displaced therefrom said predetermined distance.

The first- and second-stage curing procedures differ from each other in the energy dose (intensity) and preferably also wavelength. Preferably, the first-stage curing utilizes about 5% or less (generally, up to about 15%) of the energy of the second-stage curing. For example, the first- and second-stage curing intensities are, respectively, about 20 mJ/cm$^2$ and 200 mJ/cm$^2$. The wavelength of UV-radiation used in the first-stage curing is for example 350 nm or more, while that of the second-stage curing is less than 350 nm.

The following is the example of the operational mode of the apparatus 10. When the print head assembly 12 operates to print on the substrate in one direction—the positive X-direction, the curing unit 16B is in its inoperative position, and the curing unit 16A is in its operative position to continuously apply the first-stage curing radiation to successive locations along a print line on the substrate with a certain time-delay $t_1$ between the printing and the first-stage curing processes, constant for all locations (dots) in the print line. Then, the control unit 18 operates the drive assembly 15B to displace the substrate in the Y-direction so as to bring the next line to printing position. The print head assembly 12 and the curing units 16A and 16B are then displaced in the opposite direction—negative X-direction. During this movement, the curing unit 16A is inoperative, while unit 16B is shifted into its operative position, and concurrently, the curing unit 16C is operated to apply the second-stage curing to the first printed line thus providing a time delay $t_2$ between the first- and second-stage curing processes. It should be noted that that the second-stage curing may start after printing and first-curing of several print lines, and the second-stage curing may be simultaneously applied to these several previously printed and first-cured print lines.

Figure 1B:
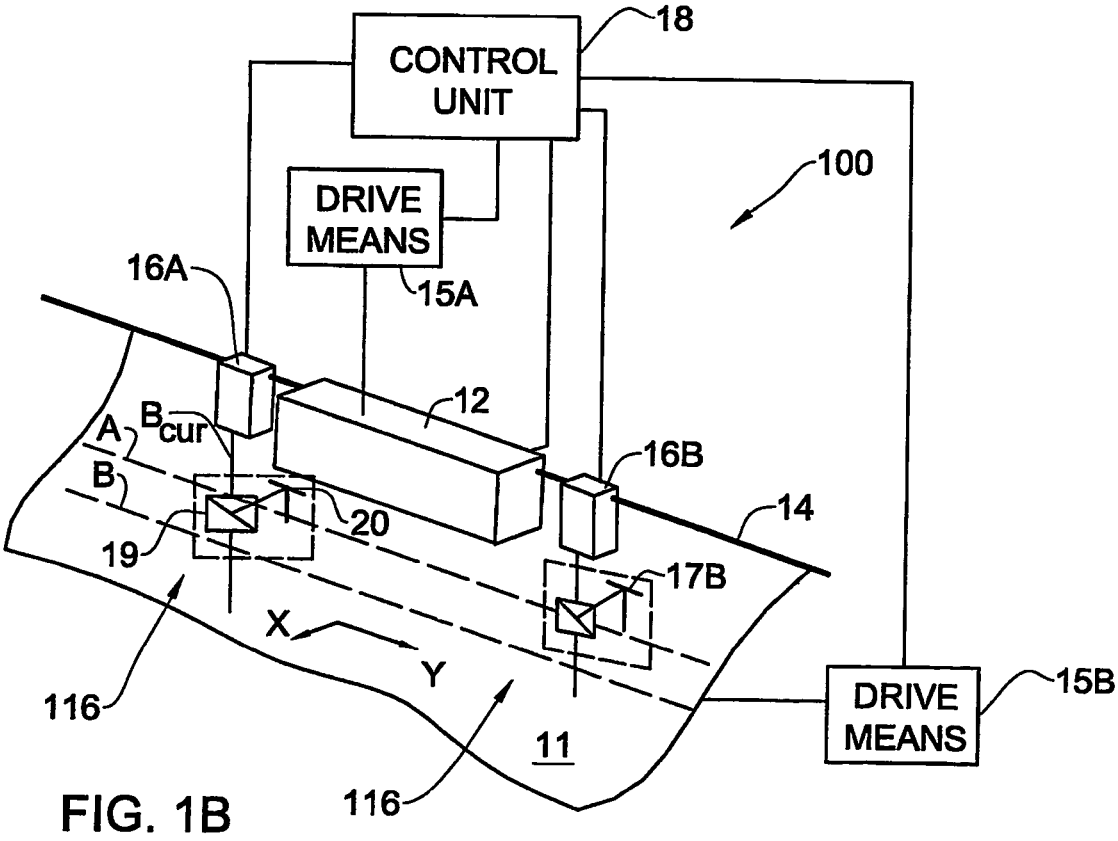
FIG. 1B illustrates a printing apparatus according to another embodiment of the invention configured to implement bi-directional printing and double-stage UV curing of the printed ink.

FIG. 1B illustrates a printing apparatus 100 according to another embodiment of the invention configured for carrying out a bi-directional printing, and also a double-stage UV-curing using the same curing radiation source but adjustable energy dose and wavelength of curing. To facilitate understanding, the same reference numbers are used to identify those components which are common in all the examples of the invention.

In the apparatus 100, a UV-curing assembly 116 includes a pair of UV-light sources 16A and 16B equipped with radiation directing arrangements 17A and 17B, respectively. The radiation directing arrangement includes a beam splitting element 19 and a mirror 20. The beam splitter 19 is accommodated in the path of a curing beam $B_{cur}$ generated by the radiation source and splits the beam $B_{cur}$ (e.g., in a wavelength-selective manner) into first and second radiation portions with a predetermined power ration (as described above), such that the first radiation $B^{(1)}{}_{cur}$ is directed towards a location on line B on the substrate and the other radiation $B^{(2)}{}_{cur}$ is directed towards the mirror 20 that reflects this beam portion onto a location on the previously printed line A on the substrate (i.e., located downstream of line B with respect to the positive Y-direction). Thus, during the printing of line B, one of the curing units 16A and 16B (depending on the printing direction) is operable to concurrently perform the first-stage curing of line B and the second-stage curing of the previously printed line A.

The present invention provides for on-line gloss control of inkjet printed images to achieve improved adhesion, better drop shaping and better shrinkage properties. This is implemented by controlling the delay time between the application of the ink (printing) to a certain location on the substrate and curing the printed ink, and also by controlling the amount of curing energy and wavelength of the curing radiation. With typically used single-stage curing, the printed ink is irradiated with high intensity UV radiation and the resulting images normally have a matte finish. In order to achieve a glossy finish, the present invention utilizes a double-stage curing: the first-stage curing—energy with relatively low intensity and long wavelength irradiates the ink droplet that was applied to the substrate, and the second, delayed curing stage—higher amount of energy with shorter wavelength irradiates the same droplet after a certain time period from the first-stage curing.

Figure 2A:
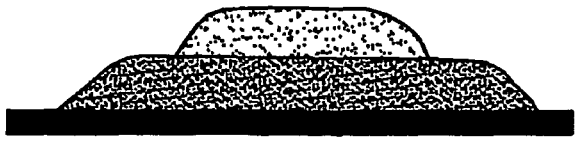
FIGS. 2A and 2B illustrate the results of the first- and second-stage UV curing, respectively.
Figure 2B:
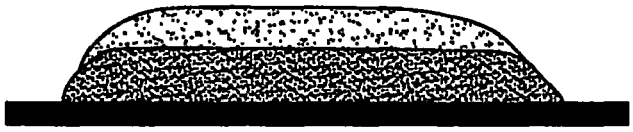

FIGS. 2A-2B illustrate the results of the first- and second-stage UV curing, respectively. Ink droplets, while formed and jetted from the print head 12, are high speed, causing development of negative pressure close to the surface of the ink droplets. Hence, atmospheric air (including oxygen) is drawn into the droplet. The enclosed oxygen interferes the polymerization of the radical chains, thus causing low-dose, long-wavelength curing to be sufficient and virtually effective for gelling the bottom of the jetted droplet while leaving the surface of the droplet fluidic and uncured. Curing the bottom of the droplet controls spreading and improves color density and resolution, while delaying the surface curing of the ink drop results in a smoother drop surface which gives rise to glossiness. The curing method of the present invention also advantageously provides creating symmetrical curing, and as a result symmetrical drop shapes are produced, thus minimizing the common problem of banding phenomena that appears in the printed and cured image, because of simultaneous bi-directional one-step curing (which leads to un-symmetrical completely cured drop shapes. As shown in FIG. 2B, the partially cured surfaces wet completely as related to partial wetting of the cured layer in one-step curing process.

Figure 3:
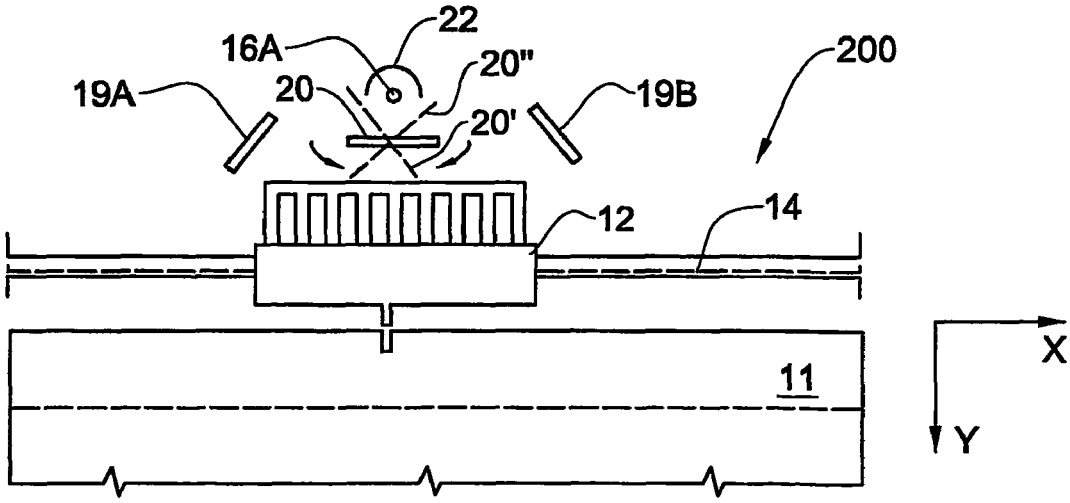
FIG. 3 is a schematic diagram of a printing apparatus according to another embodiment of the invention configured to implement a bi-direction printing, and implement bi-directional UV curing with a single UV-curing light source.

Reference is now made to FIG. 3 showing a schematic diagram of a printing apparatus 200 constructed and operated according to yet another embodiment of the invention. The same reference numbers identify common components in all the examples of the invention. The apparatus 200 comprises a print head assembly 12 mounted on a guide 14; a UV-curing assembly 216; and a control unit and drive assembly (not shown here).

The curing assembly 216 is configured to enable bi-directional curing (during bi-directional printing) with a single UV-radiation source 16A. To this end, the curing assembly 216 includes a radiation directing arrangement 17A comprising first and second mirrors 19A and 19B, accommodated symmetrically identical at opposite sides of the radiation source 16A and at opposite sides of the print head assembly 12, and an adjustable mirror 20 that is accommodated in the optical path of curing beam $B_{cur}$ coming from the radiation source 16. The mirror 20 is mounted for rotation between its first and second operative positions 20' and 20" (shown in the figure in dashed lines) to reflect the curing beam towards, respectively, the first and second mirrors 19A and 19B. Each of the mirrors 19A and 19B is spaced from the print head assembly 12 a certain distance so as to provide a certain delay between the printing and curing processes for each location on the substrate. As also shown in the figures, the curing assembly preferably also comprises an arc-shaped mirror 22 surrounding the radiation source 16A and directing UV-radiation generated by the source 16A towards the rotatable mirror 20. The provision of this arc-shape mirror 22 is aimed at directing almost all the radiation emitted by the radiation source 16A towards the substrate.

Figure 4A:
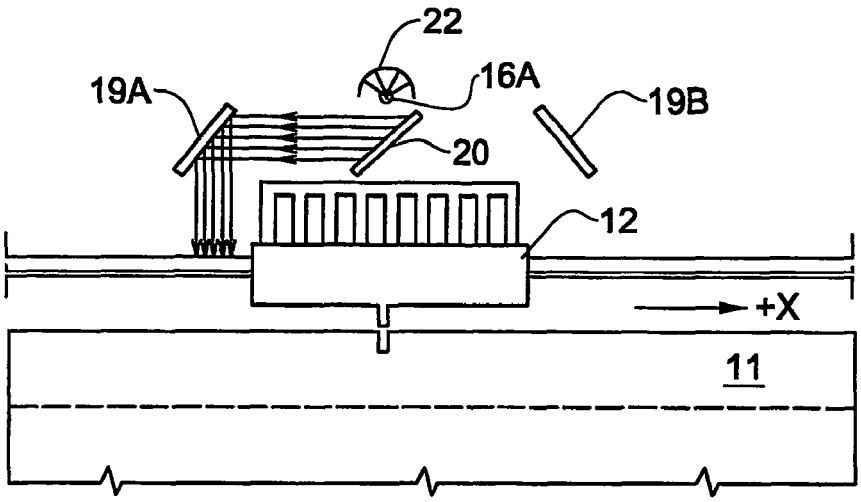
FIGS. 4A and 4B illustrate the operation modes of the printing apparatus of FIG. 2 in opposite printing directions.

As shown in FIG. 4A, when the print head assembly 12 moves in the positive X-direction and curing of the printed line in this direction is carried out, the mirror 20 is in its first operative position thus reflecting the curing beam towards the first mirror 19A, which in turn reflects the beam to the substrate. When printing and curing in the opposite direction is to be carried out (FIG. 4B), the mirror 20 is rotated so as to face by its reflective surface the second mirror 19B and thus reflect the curing beam to the second mirror 19B.

Figure 4B:
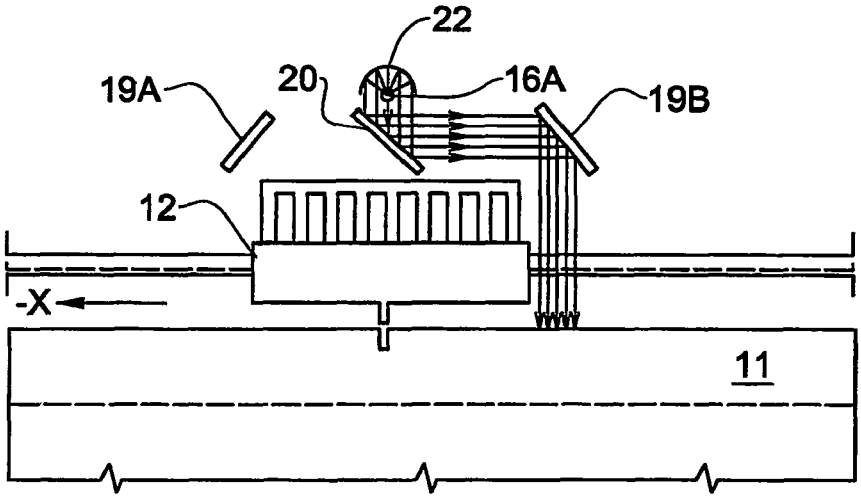

In the example of FIGS. 3 and 4A-4B, the entire curing assembly (the radiation source and the radiation directing arrangement) are movable together with the print head assembly 12. Similarly to the above-described examples of FIGS. 1A-1B, mirrors 19A and 19B may be either kept at a certain fixed distance from the print head assembly, or may be displaceable therefrom. The radiation source 16A may be located adjacent to the print head assembly, or remotely therefrom in which case radiation is directed from the source towards mirror 20 via a fiber.

Figure 5A:
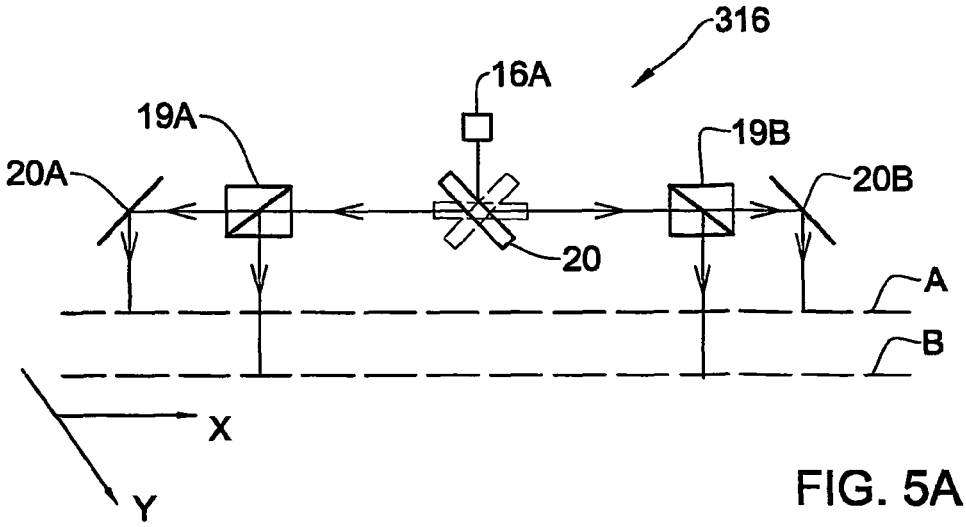
FIGS. 5A to 5C schematically illustrate several additional examples of the configuration of the curing assembly suitable to be used in the printing apparatus of the present invention.
Figure 5B:
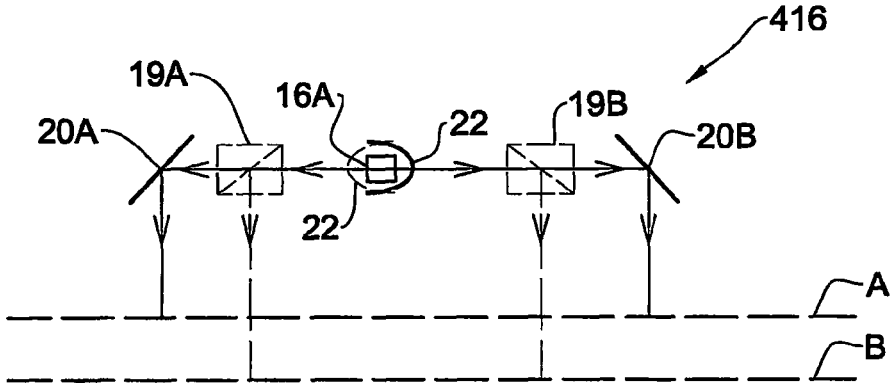
Figure 5C:
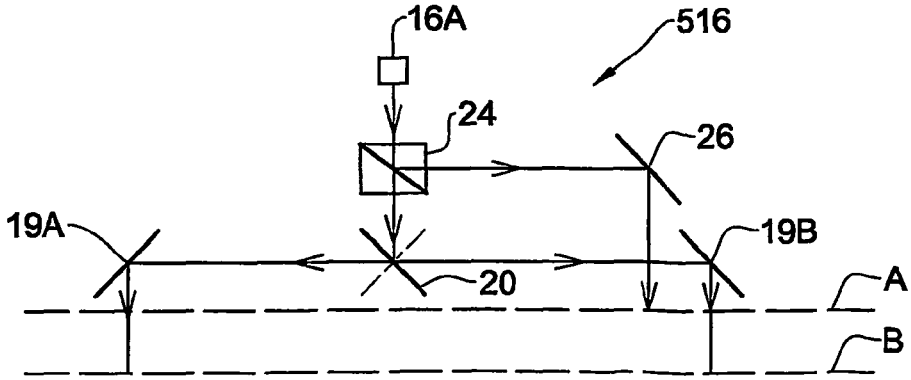

FIGS. 5A-5C exemplify several additional possible configurations of the curing assembly according to the invention providing fir using the single curing radiation source for double-stage curing. The use of the single radiation source simplifies and reduces the size and weight of the entire system, and also provides for uniform curing of all the printed locations on the substrate.

In the example of FIG. 5A, the curing assembly 316 includes a radiation source 16A, and a radiation directing arrangement formed by a rotatable mirror 20, two beam splitting elements 19A and 19B accommodated symmetrically identical with respect to the mirror 20 and with respect to the print head assembly (not shown here), and two mirrors 20A and 20B associated with the beam splitters 19A and 19B, respectively. The mirror 20 thus selectively directs the curing beam to either one of the beam splitters 19A and 19B. The beam splitter 19A splits the curing beam into first and second beam portions, one being directed towards line B and the other—via mirror 20A towards line A downstream of line B (with respect to the positive Y-direction).

A curing assembly 416 of FIG. 5B is generally similar to that of FIG. 5A, and distinguishes therefrom in that the selective directing of the curing radiation to the mirrors 19A or 19B (e.g., via beam splitters 19A and 19B, if double-stage curing with the same radiation source is considered) is implemented by mounting an arc-shape mirror 22 for movement with respect to the radiation source 16A (as shown in the figure in dashed lines), thereby eliminating the need for rotatable mirror (20 in FIG. 5A).

In the example of FIG. 5C, a curing assembly 516 comprises a radiation source 16A, and a radiation directing arrangement that includes a rotatable mirror 20 and first and second mirrors 19A and 19B at opposite sides thereof. Also provided in the radiation directing arrangement is a beam splitter 24 and a mirror 26. A curing beam first passes through the beam splitter 24 that splits the beam into first and second radiation portion at a predetermined power ratio and possibly also wavelength difference. The first radiation portion propagates towards the mirror 20 that selectively reflects it to mirror 19A or 19B to thereby impinge onto print line B. The second radiation portion propagates towards mirror 26 that reflects it to line A on the substrate.

It should be understood, although not specifically shown, that in the examples of FIGS. 5A-5C, mirrors 19A and 19B (or beam splitter- and mirror assemblies 19A-20A and 19B-20B) may be either kept at a fixed distance from the print head assembly or displaceable with respect to the print head assembly along the X-axis.

The substrate (recording medium) may be made of any suitable material that is compatible with the selected inks. Examples of suitable substrates include both porous and non-porous materials such as glass, wood, metal, paper, woven and non-woven, and polymeric films. The films can be clear, translucent, or opaque. The films can be colorless, a solid color or a pattern of colors. The films can be for example transmitting or reflective. The substrate can be fed into the printing apparatus by using any of the known feeding systems, e.g. the so-called "roll-to-roll" or "flat-bed" systems.

The UV-radiation source (a traditional UV light source with focusing and collimating optics, or a UV laser) can be adapted to emit radiation with predetermined intensity and wavelength. The printing apparatus can be equipped with an intensity and wavelength controller for providing curing radiation with varied intensities.

The curing assembly may be equipped with additional elements such as filters, for filtering out unwanted energy components (e.g. visible light, infra-red radiation).

The required time delay between the printing and curing process, as well as between the first- and second-stage curing processes is controlled by the distance between the printing and curing locations. Additionally, the control unit is preprogrammed to control the time delay, and intensity and duration of the first and second curing stages, and to control the movement of the mirror and/or the radiation source to synchronize it with the movement of the print head assembly.

The present invention is particularly suitable for use in combination with a drop on demand process but, of course, may be used in combination with other ink jet printing processes, either continuous or intermittent. In the description, reference was made only to UV-curable inks but it is to be understood that, where the context permits, reference to other forms of radiation curable inks is intended.

Those skilled in the art will readily appreciate that various modifications and changes can be applied to the embodiments of the invention as hereinbefore described without departing from its scope as defined in and by the appended claims.

The invention claimed is:

1. A method for use in a digital ink-jet printer, the method comprising:

applying a radiation-curable ink to successive locations on a substrate along a first print line in a first direction and applying the radiation-curable ink to successive locations on the substrate along a second print line in a second direction opposite the first direction;

concurrently with the application of the radiation-curable ink along the first and second print lines, applying from a single radiation source first curing radiation of a predetermined first intensity to the applied ink along the first and second print lines, with a certain time delay, constant for all the locations on the substrate, between the applications of ink and the first curing radiation, wherein the applying of the first curing radiation along the first print line comprises directing the first curing radiation from the single radiation source toward the second direction, and the applying of the first curing radiation along the second print line comprises directing the first curing radiation from the single radiation source toward the first direction;

applying second curing radiation of a predetermined second intensity to the locations on the substrate a certain time period, constant for all the locations on the substrate, after the application of the first curing radiation to said locations.

2. The method of claim 1, wherein the second curing radiation is applied to the successive locations on the substrate along a print line to which the ink and the first curing radiation have previously been applied, during the application of ink and application of the first curing radiation to successive locations along a preceding print line on the substrate.

3. The method of claim 2, wherein the second curing radiation is simultaneously applied to at least two print lines, to which the ink and the first curing radiation have previously been applied.

4. The method of claim 1 wherein said predetermined first intensity is about 15% or less than that of said second intensity.

5. The method of claim 1. wherein the applying of the first curing radiation further comprises directing the curing radiation, to the successive locations on the first and second print lines.

6. The method of claim 1, wherein the first and second curing radiation is concurrently directed to spaced-apart locations on the substrate both spaced from a location to which the ink is applied, by splitting the curing radiation from the single radiation source into first and second radiation portions in a predetermined power ratio.

7. The method according to claim 1, wherein the first and second curing radiation are of different wavelengths.

8. The method according to claim 6, wherein said splitting is wavelength-selective.

9. A method for use in a digital ink-jet printer, the method comprising:

continuously applying a radiation-curable ink to successive locations on a substrate along a print line extending across the substrate;

concurrently with the continuous application of the radiation-curable ink along the along print line. continuously applying first curing radiation of a predetermined first intensity to the applied ink on the successive locations on the substrate along said print line, with a certain time delay, constant for all the locations on the substrate. between the applications of ink and the first curing radiation;

applying second curing radiation of a predetermined second intensity to the locations on the substrate a certain time period, constant for all the locations on the substrate, after the application of the first curing radiation to said locations;

wherein said radiation curable ink is applied to successive locations along the first and second successive print lines on the substrate in first and second opposite directions, respectively, said application of the first curing radiation comprises selectively directing the curing radiation, generated by a curing source, to the successive locations on the print line on the substrate in the first or second opposite direction, and said directing of the first curing radiation comprises selectively directing the first curing radiation coming from the radiation source to either one of first and second mirrors accommodated in a spaced-apart relationship along an axis of the print line at opposite sides of the print head assembly, each of the first and second mirrors being oriented to reflect radiation impinging thereon towards the location on the print line.

10. The method according to claim 9, wherein said selectively directing comprises directing the first curing radiation coming from, the radiation source to a mirror rotatable between first and second orientations of its reflective surface to face the first and second mirrors, respectively.

11. A method for use in a digital ink-jet printer, the method comprising:

continuously applying a radiation-curable ink to successive locations on a substrate along a print line extending across the substrate;

concurrently with the continuous application of the radiation-curable ink along the along print line, continuously applying first curing radiation of a predetermined first intensity to the applied ink on the successive locations on the substrate along said print line, with a certain time delay, constant for all the locations on the substrate, between the applications of ink and the first curing radiation;

applying second curing radiation of a predetermined second intensity to the locations on the substrate a certain time period, constant for all the locations on the substrate, after the application of the first curing radiation to said locations;

wherein the first and second curing radiation is concurrently directed to spaced-apart locations on the substrate both spaced from a location to which the ink is applied, by splitting the curing radiation, generated by a single radiation source, into first and second radiation portions in a predetermined power ratio; and further comprising selectively directing curing radiation coming from the radiation source towards either one of first and second radiation splitting elements, each splitting the radiation impinging thereon into first and second radiation portions presenting said first and second curing radiation, the first split radiation portion propagating towards a first print line, and the second split radiation portion being reflected to propagate towards a second print line spaced-apart from the first print line along an axis perpendicular to the print line.

12. The method according to claim 6, comprising splitting curing radiation coming from the radiation source into first and second radiation portions presenting said first and second curing radiation, and directing the first and second split radiation portions via a rotatable mirror towards first and second spaced-apart print lines on the substrate, the rotation of said rotatable mirror providing for directing the respective one of the split radiation portions of successive locations along the first and second print lines in either one of the first and second directions.

* * * * *

UNITED STATES PATENT AND TRADEMARK OFFICE

CERTIFICATE OF CORRECTION

PATENT NO. : 7,837,319 B2
APPLICATION NO. : 10/576974
DATED : November 23, 2010
INVENTOR(S) : Gregory Rodin et al.

It is certified that error appears in the above-identified patent and that said Letters Patent is hereby corrected as shown below:

In column 11, line 53, in Claim 4, delete "claim 1" and insert -- claim 1, --, therefor.

In column 11, line 56, in Claim 5, delete "claim 1." and insert -- claim 1, --, therefor.

In column 11, lines 57-58, in Claim 5, delete "radiation," and insert -- radiation --, therefor.

In column 12, line 9, in Claim 9, delete "line." and insert -- line, --, therefor.

In column 12, line 13, in Claim 9, delete "substrate." and insert -- substrate, --, therefor.

In column 12, line 42, in Claim 10, delete "from," and insert -- from --, therefor.

Signed and Sealed this
Fifth Day of April, 2011

David J. Kappos

David J. Kappos
*Director of the United States Patent and Trademark Office*